US010405681B2

(12) United States Patent
Woods

(10) Patent No.: US 10,405,681 B2
(45) Date of Patent: Sep. 10, 2019

(54) FOOD WRAP HOLDER

(71) Applicant: Madelin Woods, LLC, New York, NY (US)

(72) Inventor: Madelin Woods, New York, NY (US)

(73) Assignee: MADELIN WOODS, LLC, New York, NY (US)

( * ) Notice: Subject to any disclaimer, the term of this patent is extended or adjusted under 35 U.S.C. 154(b) by 0 days.

(21) Appl. No.: 15/953,149

(22) Filed: Apr. 13, 2018

(65) Prior Publication Data

US 2018/0296012 A1 Oct. 18, 2018

Related U.S. Application Data

(60) Provisional application No. 62/485,035, filed on Apr. 13, 2017.

(51) Int. Cl.

| | |
|---|---|
| ***A47F 1/16*** | (2006.01) |
| ***A47G 21/00*** | (2006.01) |
| ***B65D 3/04*** | (2006.01) |
| ***B65D 85/30*** | (2006.01) |
| ***B65D 83/00*** | (2006.01) |
| *B65G 59/02* | (2006.01) |

(52) U.S. Cl.

CPC ..... *A47G 21/001* (2013.01); *B65D 3/04* (2013.01); *B65D 83/0011* (2013.01); *B65D 83/0027* (2013.01); *B65D 85/30* (2013.01); *B65D 2585/54* (2013.01)

(58) Field of Classification Search

CPC .... A47G 21/001; B65D 3/04; B65D 83/0011; B65D 83/0027; B65D 85/30; B65D 2585/54; B65D 83/005; B65D 83/0083; B65D 83/02

USPC ..... 220/669, 288, 675; 221/152, 186, 209, 221/254; 426/112, 115, 394

See application file for complete search history.

(56) References Cited

U.S. PATENT DOCUMENTS

| | | | | |
|---|---|---|---|---|
| 2,444,375 A | | 6/1948 | Seaver | |
| 3,815,787 A | * | 6/1974 | Spies | A47J 9/00 222/390 |

(Continued)

FOREIGN PATENT DOCUMENTS

| | | |
|---|---|---|
| KR | 100963159 | 6/2010 |

OTHER PUBLICATIONS

International Search Report and Written Opinion for International Application No. PCT/US2018/027625, dated Jul. 2, 2018.

*Primary Examiner* — J. Gregory Pickett
*Assistant Examiner* — Niki M Eloshway
(74) *Attorney, Agent, or Firm* — Patent Law Works LLP

(57) ABSTRACT

A container including: an elevator including a circular cross section, an exterior surface defined by a circumference of the circular cross section, and a first lug extending a first dimension normal to the exterior surface; a ramp shell and a drive shell having a common axis of rotation and including a thickness, a first edge surface and a second edge surface separated by a gap, and the gap continuing a length of the first edge surface and the second edge surface defining a lug channel; and the ramp shell having a first continuous helical groove recessed into the interior surface, and, when the ramp shell is rotated in a first direction relative to the drive shell, the first lug travels in a first direction along the lug channel

19 Claims, 12 Drawing Sheets

(56) References Cited

U.S. PATENT DOCUMENTS

| | | | | |
|---|---|---|---|---|
| 6,039,483 | A | 3/2000 | Szekely | |
| 7,140,518 | B2 * | 11/2006 | Wang | B05B 9/0838 222/390 |
| 8,240,932 | B1 | 8/2012 | Perez Espartero et al. | |
| 10,070,742 | B2 * | 9/2018 | Chen | A47G 19/183 |
| 2013/0313258 | A1 | 11/2013 | Sines | |
| 2014/0131366 | A1 | 5/2014 | Lim | |
| 2014/0197171 | A1 | 7/2014 | Taylor et al. | |

* cited by examiner

FOOD WRAP HOLDER

CROSS-REFERENCE TO RELATED APPLICATIONS

This application claims priority, under 35 U.S.C. § 119, to U.S. Provisional Patent Application No. 62/485,035, filed Apr. 13, 2017, and entitled "Food Wrap Holder" the entirety of which is hereby incorporated by reference.

BACKGROUND

1. Field of the Invention

The present invention is directed to a container system that improves the storage, dispensing, and consumption of a wrap.

2. Description of the Background Art

Consumption of wraps, such as burritos, can be difficult and messy. A wrap may not be set down while eating it without substantial risk of falling over or spilling, which also makes it difficult to store partially consumed wraps and resume consumption at a later time. Foil is often used to encase a wrap. However, foil is not reusable, and unwrapping foil is cumbersome, and a consumer risks biting off a piece of the foil while eating the wrap. The food wrapping (e.g. tortilla, lettuce, etc.) may also have time-sensitive structural integrity, e.g., because wet fillings begin to dissolve or otherwise compromise the food wrapping. The variation in dimensions of wraps even when made by the same entity present further difficulty for storage and dispensing a wrap for consumption. Carrying multiple wraps (e.g. to share with others is also difficult). Therefore, a product that addresses one or more of these wrap-related difficulties is desirable.

SUMMARY

One general aspect of the disclosure includes a container including: an elevator including (1) a circular cross section when viewed along a first axis, (2) an exterior surface defined by a circumference of the circular cross section, and (3) a first lug extending a first dimension normal to the exterior surface and extending a second dimension normal to the first dimension; a ramp shell and a drive shell having a common axis of rotation, where the common axis of rotation is the first axis; the drive shell including (1) a thickness, (2) a first edge surface and a second edge surface separated by a gap having a third dimension that is greater than the second dimension of the first lug, and (3) the gap continuing a length of the first edge surface and the second edge surface defining a lug channel; and the ramp shell having an interior surface including a first continuous helical groove recessed into the interior surface, where the first dimension of the first lug exceeds the thickness of the drive shell, and the first lug extends into the first continuous helical groove recessed into the interior surface of the ramp shell, where, when the ramp shell is rotated in a first direction relative to the drive shell, the first lug travels in a first direction along the lug channel.

Implementations may include one or more of the following features. The container where the ramp shell includes: a first ramp shell component including a first edge, a second edge, a half-pipe cross section when viewed along the first axis and a first portion of helical groove recessed into an interior surface of the first ramp shell component; and a second ramp shell component including a first edge, a second edge, a half-pipe cross section when viewed along the first axis and a second portion of helical groove recessed into an interior surface of the first ramp shell component; and where, when the first edge of the first ramp shell component is aligned with the first edge of the second ramp shell component, and when the second edge of the first ramp shell component is aligned with the second edge of the second ramp shell component, the first portion of helical groove and the second portion of helical groove form the first continuous helical groove recessed into the interior surface of the ramp shell. The container where the first portion of helical groove and the second portion of helical groove also form a second continuous helical groove recessed into the interior surface of the ramp shell. The container where the first portion of helical groove includes a first flared section at the first edge of the first ramp shell component and a second flared section at the second edge of the first ramp shell component. The container where the first ramp shell component is molded using a mold, and where the mold includes features for creating the first portion of helical groove including the first flared section at the first edge of the first ramp shell component and the second flared section at the second edge of the first ramp shell component during the molding of the first ramp shell component. The container where the first ramp shell component is molded plastic. The container where the second portion of helical groove includes a first flared section at the first edge of the second ramp shell component and a second flared section at the second edge of the second ramp shell component. The container where the first lug is elongated in a direction corresponding to the first continuous helical groove. The container where the first lug is elongated along an angle corresponding to a pitch of the first continuous helical groove. The container where, when the first lug travels in the first direction along the lug channel, the elevator moves parallel to, or along, the common axis of rotation. The container where a direction of the lug channel is parallel to the common axis of rotation or along the common axis of rotation. The container where the elevator includes a second lug extending the first dimension normal to the exterior surface and the second dimension normal to the first dimension, where the second lug is positioned opposite the first lug on the circular cross section of the elevator. The container where the elevator includes an interior surface that forms a basin. The container bottom component coupled to a first end of the drive shell, where, when the bottom component is rotated, the drive shell is rotated with the bottom component around common axis of rotation and the drive shell moves relative to the ramp shell. The container further including: an insulating outer shell surround at least a portion of the ramp shell. The container further including: an outer shell surround at least a portion of the ramp shell, where a vacuum is pulled and maintained between the outer shell and the ramp shell. The container where a portion of the exterior surface of the elevator is in contact with an inner surface of the drive shell, and where friction between the inner surface of the drive shell and the exterior surface of the elevator prevents back-driving under load. The container where under load includes a weight of a wrap supported by the elevator.

One general aspect includes a ramp shell including: a first ramp shell component including a first edge, a second edge, a half-pipe cross section when viewed along a common rotational axis and a first portion of helical groove recessed into an interior surface of the first ramp shell component, where the first portion of helical groove includes a first flared section at the first edge of the first ramp shell component and a second flared section at the second edge of the first ramp shell component; and a second ramp shell component including a first edge, a second edge, a half-pipe cross section when viewed along the common rotational axis and a second portion of helical groove recessed into an interior surface of the first ramp shell component, where the second portion of helical groove includes a first flared section at the first edge of the second ramp shell component and a second flared section at the second edge of the second ramp shell component; and where, when the first edge of the first ramp shell component is aligned with the first edge of the second ramp shell component, and when the second edge of the first ramp shell component is aligned with the second edge of the second ramp shell component, the first portion of helical groove and the second portion of helical groove form a first continuous helical groove recessed into the interior surface of a ramp shell including the first ramp shell component and the second ramp shell component.

Implementations may include one or more of the following features. The ramp shell where the first ramp shell component is molded using a mold, and where the mold includes ridges for creating the first portion of helical groove includes a first flared section at the first edge of the first ramp shell component and a second flared section at the second edge of the first ramp shell component during the molding of the first ramp shell component.

It should be understood that the preceding are merely examples of embodiments and features described herein and that other embodiments, features and variations are contemplated and disclosed herein.

BRIEF DESCRIPTION OF THE DRAWINGS

Various embodiments are illustrated by way of example, and not by way of limitation in the figures of the accompanying drawings in which like reference numerals are used to refer to similar elements.

DETAILED DESCRIPTION

In the following detailed description, reference is made to the accompanying drawings, which form a part hereof, and in which is shown by way of illustration specific example embodiments. The following detailed description, therefore, is not to be taken in a limiting sense.

Embodiments described herein are directed to a container system that improves the storage, dispensing, and consumption of a wrap. A wrap is a food item with an edible wrap. Examples of wraps include, but are not limited to, burritos, taquitos, lettuce wraps, sandwich wraps, etc. Examples of edible wraps include, but are not limited to, tortilla (e.g. wheat, white, spinach, etc.), lettuce, rice paper, etc. For clarity and convenience, the disclosure may occasionally refer to a burrito in examples. However, this disclosure is not limited to wraps that are burritos.

It is contemplated and within the scope of this disclosure that different embodiments of the container may use different materials and combinations of materials to make container and the components thereof described in the Figures and below description. Those materials may include, but are not limited to metals (e.g. steel, aluminum, etc.), plastics (e.g. food grade plastics, BPA free plastic, High-Density Polyethylene (HDPE), etc.), ceramics (e.g. glass), and composites (e.g. carbon fiber).

The size of the container may vary depending on the embodiment. In one embodiment, a range of sizes are available. For example, a small size (e.g. for taquitos), a medium size (e.g. for sandwich wraps), and a large size (e.g. for large burritos). In some embodiments, the overall height of the container (e.g. a medium container or one-size-fits-most) is 6-12 inches tall and 2.5-6 inches in diameter.

Figure 1:
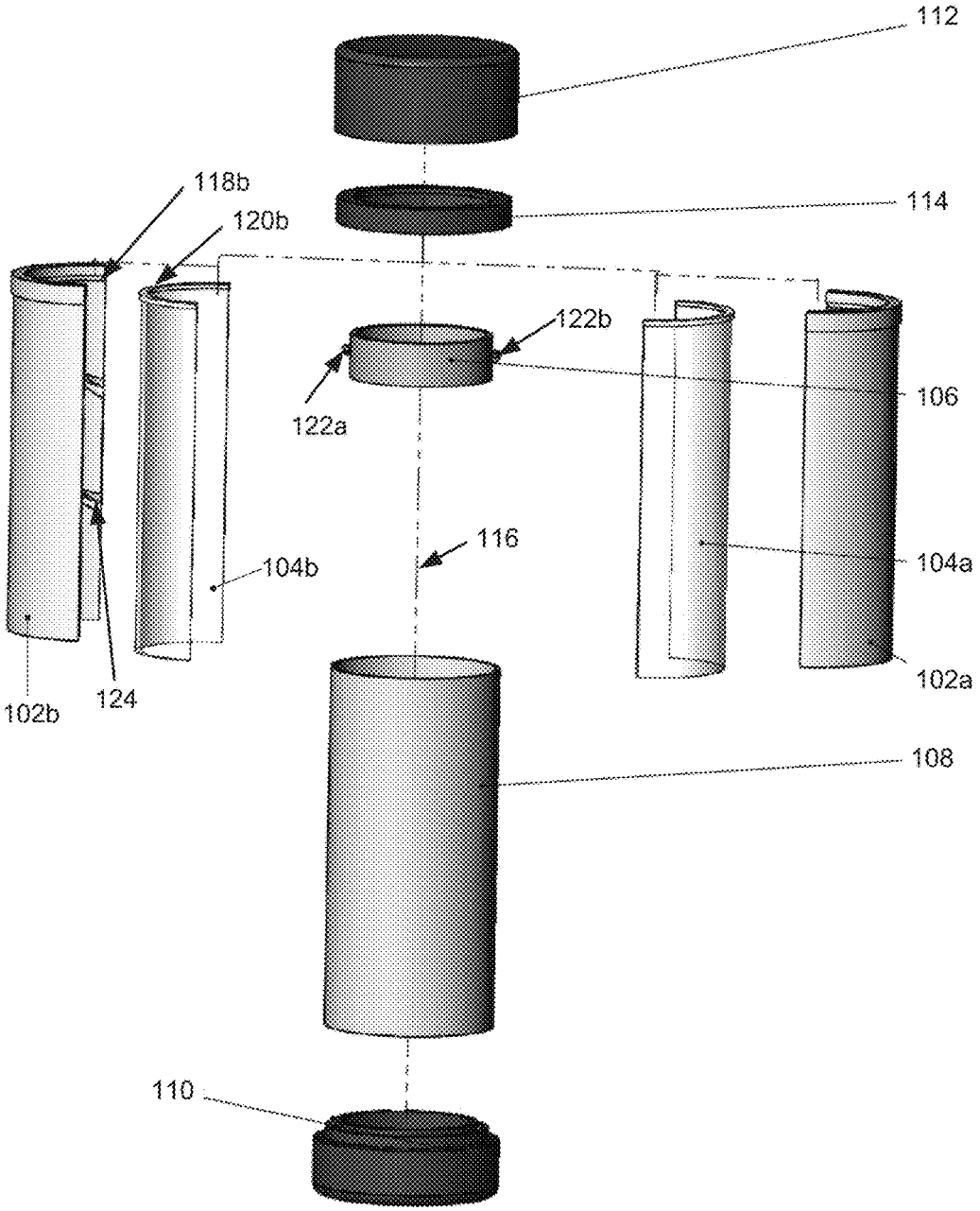
FIG. 1 is an illustration of full assembly, exploded view of a container according to one embodiment.

FIG. 1 is an illustration of full assembly exploded view of a twist-dispensing wrap container according to one embodiment. In FIG. 1, a first ramp shell component 102*a*, a second ramp shell component 102*b*, a first drive shell component 104*a*, a second drive shell component 104*b*, a carriage 106, an outer shell 108, a bottom cap 110, a cap 112, and top ring 114 are shown according to one embodiment.

Figure 2:
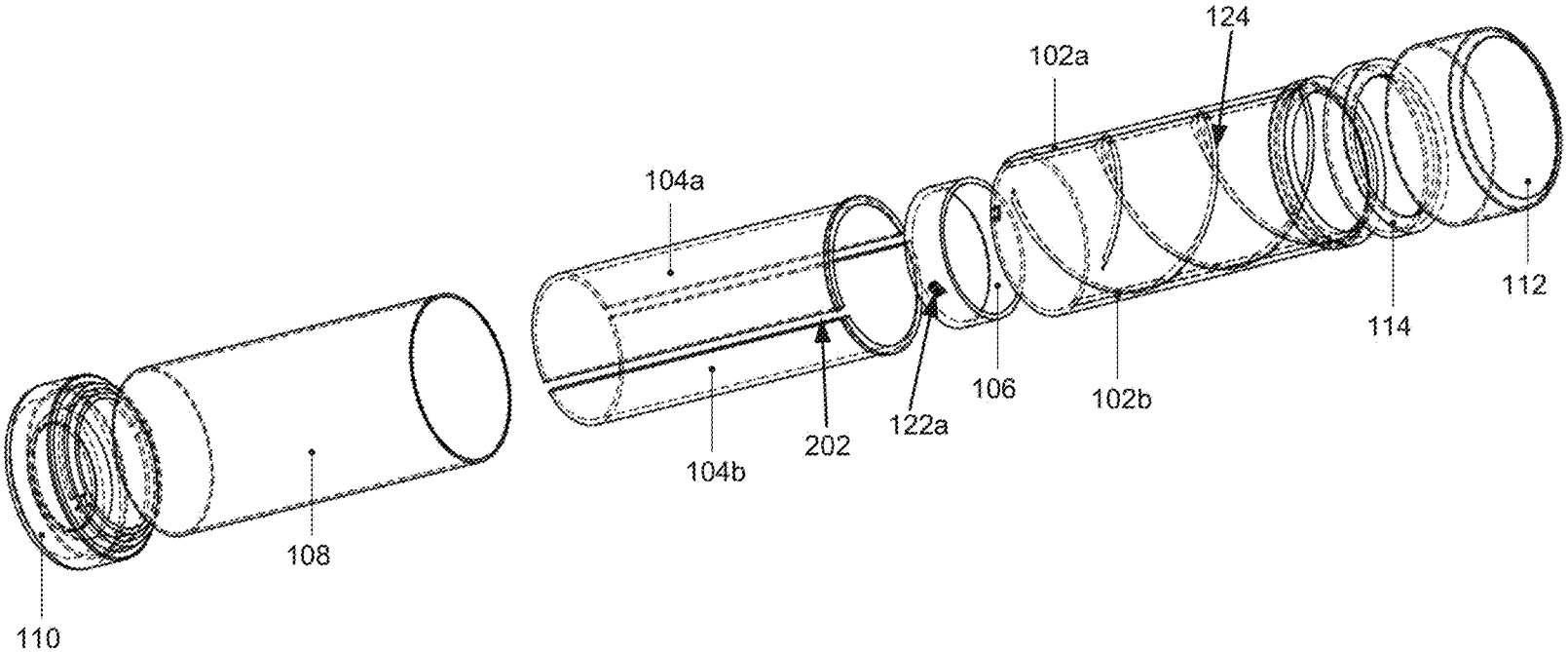
FIG. 2 is an illustration of full assembly, exploded view of a container with hidden lines shown according to the same embodiment.

FIG. 2 is an illustration of full assembly exploded view of a twist-dispensing wrap container with hidden lines shown according to the same embodiment. In FIG. 2, a first ramp shell component 102*a*, a second ramp shell component 102*b*, a first drive shell component 104*a*, a second drive shell component 104*b*, a carriage 106, an outer shell 108, a bottom cap 110, a cap 112, and top ring 114 are shown according to one embodiment.

In the illustrated embodiment of FIG. 1, the first ramp shell component 102*a* and the second ramp shell component 102*b* are separate pieces and are referred to collectively herein as a ramp shell 102. However, it should be recognized that in alternative embodiments, such as the embodiment illustrated by body component 2 in FIG. 6 and in FIG. 7, a ramp shell may be a single component according to some embodiments.

In some embodiments, whether the ramp shell 102 is a single component or combination of multiple components may allow for, or be better suited to, different methods of manufacture for the ramp shell 102. For example, in the illustrated embodiment of FIG. 1, the ramp shell 102 comprises two components—the first ramp shell component 102*a* and the second ramp shell component 102*b*. A multiple-component ramp shell may allow for manufacture of the components with the lug ramp (described in detail below with reference to FIGS. 4A and 4B) already incorporated, e.g., using a molding process (e.g. injection molding) or stamping process. In another example, a single-component ramp shell, such as that in the illustrated by body component 2 in FIG. 6 and in FIG. 7, may be 3D printed with the ramp or extruded as a tube and the ramp added to the inner surface of the tube (e.g. using a milling process, rifling process, using a tap, or similar).

Depending on the embodiment, the ramp may be recessed into the inner surface of the ramp shell or may be proud of the inner surface of the ramp shell 102. In the illustrated embodiments of FIGS. 1, 2, 3B-4B and 6-8 the ramp is recessed. The recessed ramp is occasionally referred to herein as a groove. In some embodiments, the ramp's shape may be described as a "spiral" or "helical," since the interior surface of the ramp shell, on which the lug ramp resides, is tubular resulting in a helix or a spiral as illustrated, e.g., in FIG. 2 as well as other Figures.

Referring to FIG. 1, only a small portion of the lug ramp is visible on ramp shell component 102*b*, e.g., where indicated at 124. The portion of the lug ramp 124 on ramp shell component 102*b* is not itself helical in isolation, but forms a spiral, or helix, in combination with the portion of the lug ramp on ramp shell component 102*a* as is illustrated in FIG. 2.

FIG. 2, which includes hidden lines, illustrates a multi-component ramp shell that includes ramp shell components 102*a* and 102*b*. As illustrated, ramp shell components 102*a* and 102*b* have cross sections that may be described as that of a half-pipe or semi-circular when viewed, e.g., along axis 116. When the ramp shell components 102*a* and 102*b* are aligned to form a completed ramp shell 102, the completed ramp shell may have the cross section of a full-pipe, which may also be referred to herein as pipe, tube, or annular extrusion. The portions of the ramp on each of the ramp shell components 102*a* and 102*b* align to create one or more continuous, helical ramps. In the illustrated embodiment, the carriage 106 has two lugs 122*a* and 122*b*; and, therefore, the inner surface of the ramp shell illustrated includes two helical grooves to accommodate the two lugs 122*a* and 122*b*.

In some embodiments, the continuous helical lug ramp 124 runs the length of the ramp shell 102 or substantially the length of the ramp shell 102 (e.g. close enough to each end of the ramp shell 102 to actuate the carriage 106 to the have a surface flush or substantially flush with the top of the container when in the fully extended position, and to actuate the bottom surface of the carriage to contact a bottom surface of the cavity, also occasionally referred to herein as the "bore," (e.g. contact a top surface of the bottom cap 110) when in the fully retracted position.

It should be recognized that while this specification uses the term "continuous" to describe the ramp. However, the continuity may be continuity of the ramp itself, continuity of contact between the lug and the ramp, or both. For example, embodiments where the inner surface and/or ramp has striations or portions otherwise removed (not shown) are contemplated and within the disclosure herein. Striations may save weight, save material, or be used to modify a lug's 122 travel characteristics along the lug ramp 124, for example, to increase or decrease friction). In some such embodiments, such striations are smaller in dimension than a span of a lug (e.g. <50%), so that a lug 122 is unable to enter, catch or bind on the striations as the lug 122 traverses the lug ramp 124.

In the illustrated embodiment of FIG. 1, the first drive shell component 104*a* and the second drive shell component 104*b* are separate pieces and are referred to collectively herein as a drive shell 104. However, it should be noted that in alternative embodiments, such as the embodiment illustrated in FIGS. 6-8, a drive shell may be a single component and may or may not incorporate other components, such as the bottom cap 110, into a single component analogous to base component 0 of FIG. 6. Similar to the ramp shell 102, whether the drive shell 104 is a single component or combination of multiple components may allow for, or be better suited to, different methods of manufacture.

The drive shell 104 includes a lug channel which contains and directs the travel of the lug toward the top or bottom of the holder (depending on direction of rotation of the drive shell 104 relative to ramp shell 102. An example of a lug channel is indicated at 202 in FIGS. 2 and 3C. In the illustrated embodiment, the lug channel has a uniform gap between the edge surfaces of 104*a* and 104*b*. In the illustrated embodiment, the lug channel is straight in a direction parallel to the common rotation of access (e.g. up and down). However, in some embodiments, the lug channel formed by the drive shells 104*a* and 104*b* may be at an angle or helical, which may have a similar affect to modifying the pitch of the lug ramp 124 on the interior surface of the ramp shell, and thereby modifies the effective pitch of the ramp. The lug channel contains a lug 122*a* between the edge surfaces of the drive shell 104. Therefore, in one embodiment, the width of the gap that forms the lug channel 202 is greater than or equal to the dimension of a carriage 106 lug 122 in that same plane. When the drive shell 104 and the ramp shell 102 are rotated around the common rotational axis 116 relative to one another, the lug 122*a* is forced along the lug channel 202 (e.g. up or down depending on the direction of rotation).

The carriage 106, also occasionally referred to herein as an "elevator," moves up and down within the cavity created within the drive shell 104, thereby extending or retracting the wrap, (depending on direction of rotation of the drive shell 104 relative to the ramp shell 102 around their common rotational axis 116). In the illustrated embodiment of FIGS. 1 and 2 the carriage 106 has a circular cross section when viewing the carriage 106 from above or below (e.g. along axis 116 of FIG. 1). While cross sections other than round are possible and contemplated within this description, a substantially round cross section may maximize the contact area between the circumferential surface (i.e. the surface on which the lugs are illustrated) of the carriage 106 and the inner surface of the drive shell 104. This increased surface contact prevents food or other debris from making its way between the carriage 106 and drive shell 104 and under the carriage 106 (where it may interfere with retraction and be more difficult to remove during cleaning).

Additionally, tight tolerances and more surface area between the drive shell 104 and the carriage 106, between the drive shell 104 and the ramp shell 102, or both may increase the ability of the carriage to resist back-back driving even with aggressive pitch, or effective pitch, to the lug ramp 124. Back-driving as used herein refers to a scenario in which the load exerted on the carriage (typically that of the wrap in isolation or with additional force from setting the container down on a table creating an impulse of force) causes the carriage 106, and therefore wrap, to retract (e.g. the drive shell 104 and the ramp shell 102 move relative to one another so the lug 122 moves down the lug channel retracting the carriage 106 and the wrap with it) without user operation (e.g. twisting to retract the wrap or manually preventing the drive shell 104 from moving relative to the ramp shell 102). For example, in one embodiment, a pitch resulting in 8 inches of vertical carriage 106 travel in 1.5 revolutions without back-driving under load of a wrap, and while still operating smoothly and easily when operated by a user, has been achieved.

In some embodiments, the carriage 106 includes a basin, also occasionally referred to herein as a "reservoir," as illustrated in FIGS. 1, 2, 3B and 3C. Such embodiments may beneficially catch and hold liquids from the wrap in the reservoir where it may be more easily cleaned out. In other embodiments, the top of the carriage may be a flat surface.

The carriage 106 includes one or more lugs 122. In the illustrated embodiments of FIGS. 1 and 2, the carriage 106 includes two lugs 122*a* and 122*b*, which are on opposite sides of the exterior surface of the carriage 106. A lug 122 is material coupled to the carriage 106, whether integrally (e.g. carved out or molded as part of the carriage), mechanically (e.g. using a mechanical fastener), chemically (e.g. using glue) or otherwise. The lug 122 extends in a first direction from the exterior (e.g. perimeter) surface of the carriage 106 a sufficient distance to reach beyond the thickness of the drive shell 104 and interface with the ramp. Therefore, in one embodiment, the lug 122 has a first dimension normal to the exterior surface of the carriage 106 that is greater than the thickness of the drive shell and less than or equal to the sum of the thickness of the drive shell and the depth of the lug ramp 124 (or height if the ramp is proud of the inner surface of the ramp shell 102).

Figure 6:
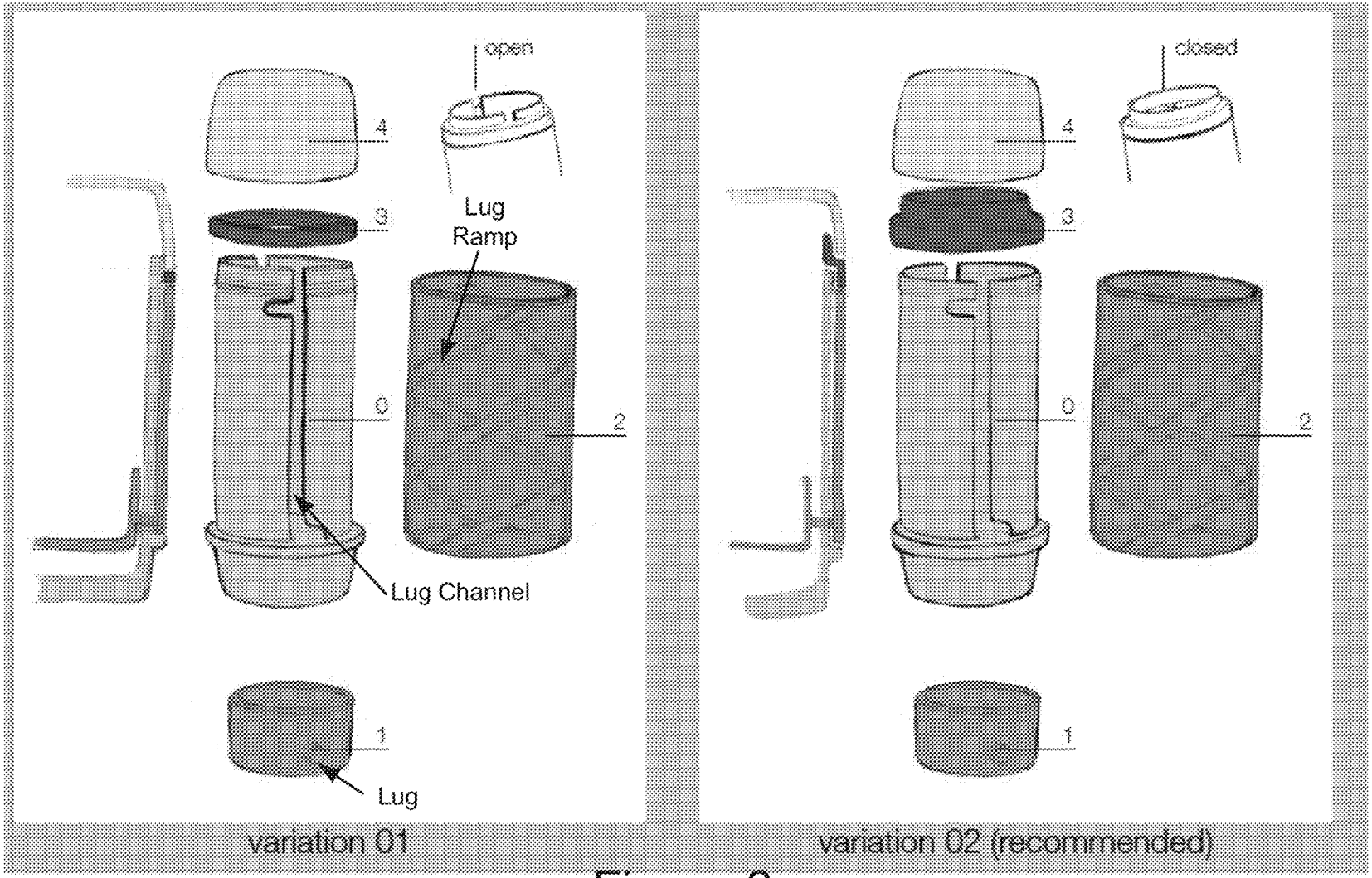
FIG. 6 illustrates the components and configuration of two example containers according to some embodiments.
Figure 7:
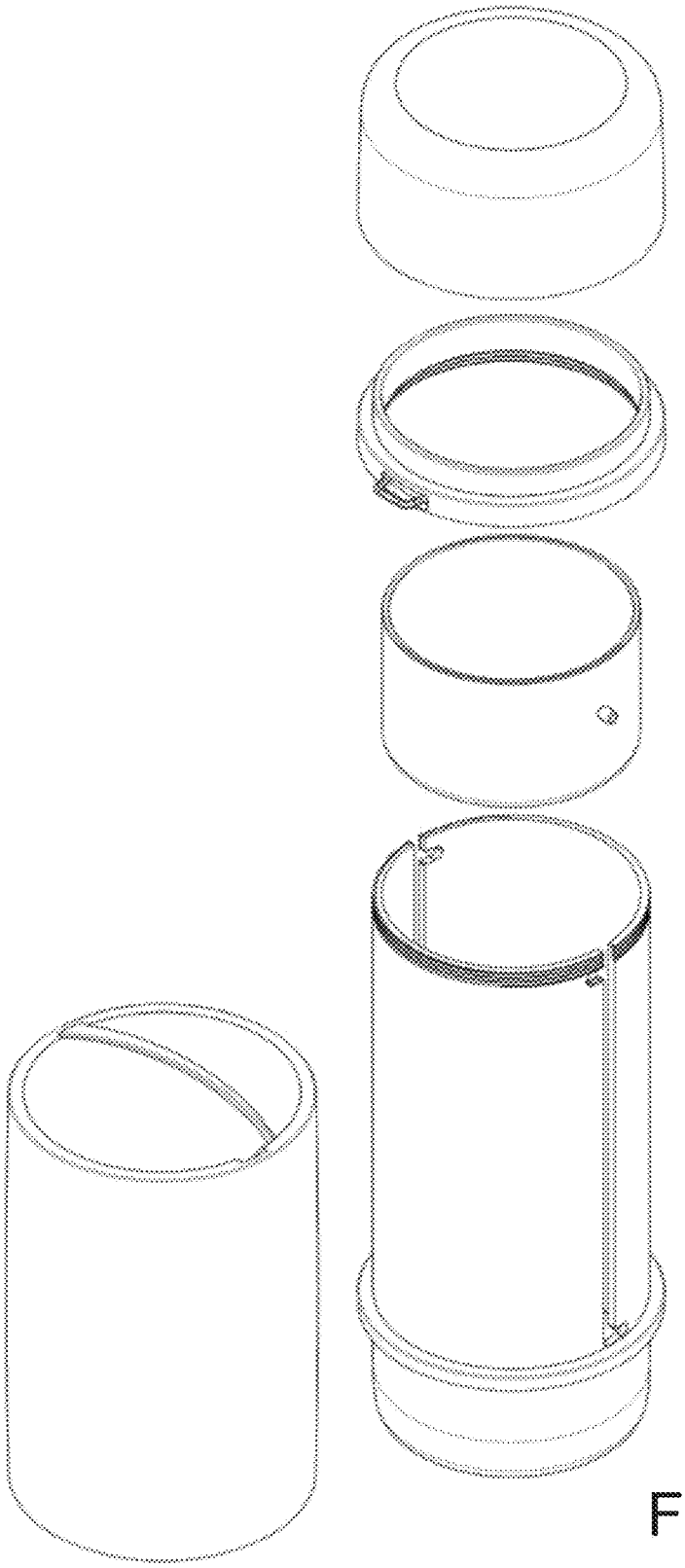
FIG. 7 is another illustration showing a full assembly, exploded view of the components of a container according to one embodiment.
Figure 8:
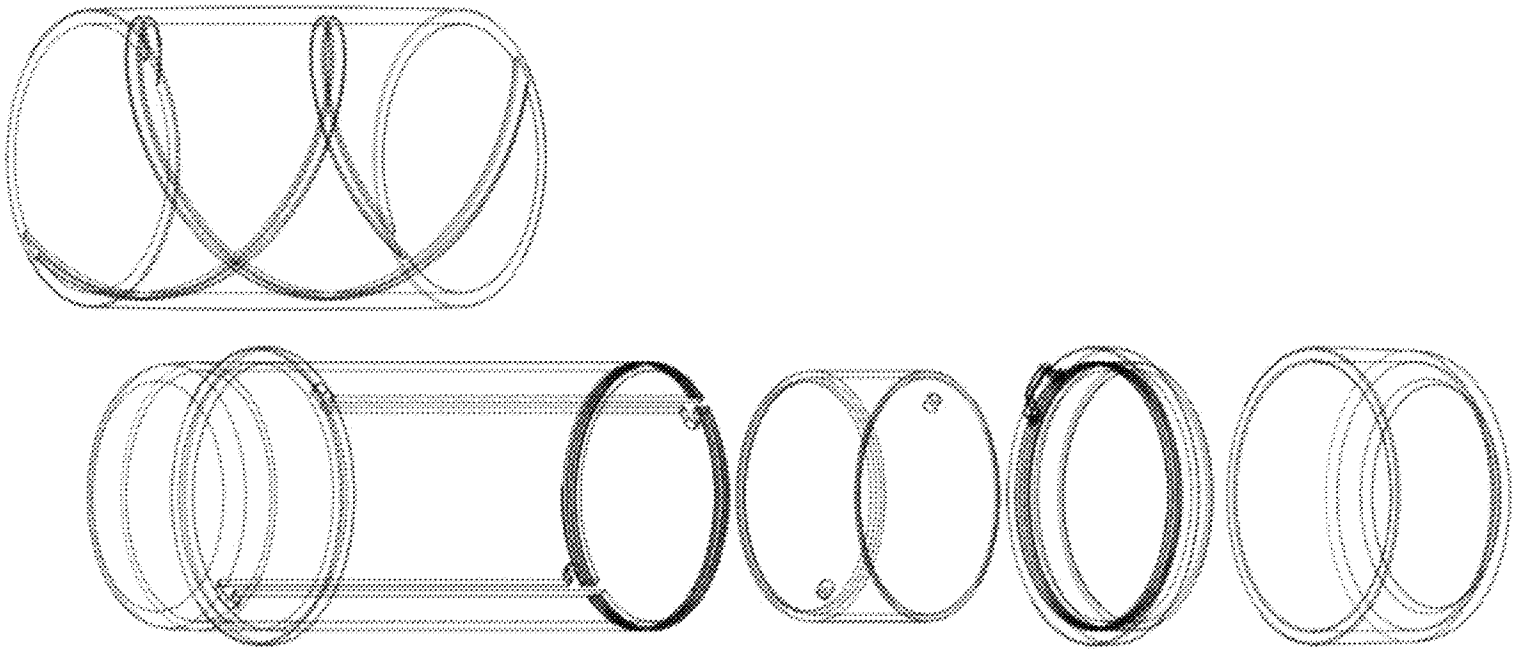
FIG. 8 is another illustration showing a full assembly, exploded view of the components of a container including hidden lines according to one embodiment.

In one embodiment, a lug 122 has a circular cross section, e.g., as illustrated in FIGS. 6-8 XXX. In another embodiment, a lug 122 may be elongated. In some such embodiments, the lug is elongated in a direction that corresponds to the pitch of the ramp 124 as illustrated by the lug 122*a* in FIG. 4A and the corresponding lug ramp 124 in FIG. 4B. Elongation in a direction corresponding to the pitch of the lug ramp 124 (e.g. at the same angle) may increase the contact area between one or more surfaces of the lug 122*a* and the lug ramp 124. The increase in contact area distributes the load over a larger surface and may allow for smoother operation and movement of the lug 122 relative to the ramp shell 102 along the lug ramp 124.

The outer shell 108 at least partially surrounds the ramp shell 102. In one embodiment, the outer shell 108 rotates in the same direction as the ramp shell 102. In some embodiments, the outer shell 108 may be acrylic, metal (e.g. stainless steel or powder coated aluminum), or other material that improves the cosmetic appearance, perception of quality of the container, durability of the container, or consumer's perception of the materials used throughout the container. In some embodiments, the outer shell 108 is mechanically (e.g. using mechanical fasteners), chemically (e.g. using glue), or integrally (e.g. welded, melted, brazed, soldered) connected to the ramp shell 102.

In some embodiments, the outer shell 108 may be insulating (e.g. incorporating a vacuum or material with a high R value such as Neoprene, Scuba foam, etc.) to help maintain the temperature of the contents of the container. In one such embodiment, a vacuum is pulled and the outer shell 108 is sealed to the ramp shell 102, thereby providing vacuum insulation to the container.

In embodiments where the ramp shell 102 comprises multiple components (e.g. 102*a* and 102*b*), the outer shell 108 may beneficially cover the seams between those components and provide a better (e.g. more uniform or seamless) surface to the eye and to a user's hand. Some embodiments may omit the outer shell 108 (e.g. the ramp shell 102 is the outermost shell.

The bottom cap 110 is a component that encloses one end of the container and forms a bottom to the cavity in which the wrap is stored. The bottom cap 110 is physically coupled to drive shell 104 so twisting the bottom cap 110 relative to the ramp shell 102 causes the drive shell 104 to also rotate relative to the ramp shell 102.

Figure 3B:
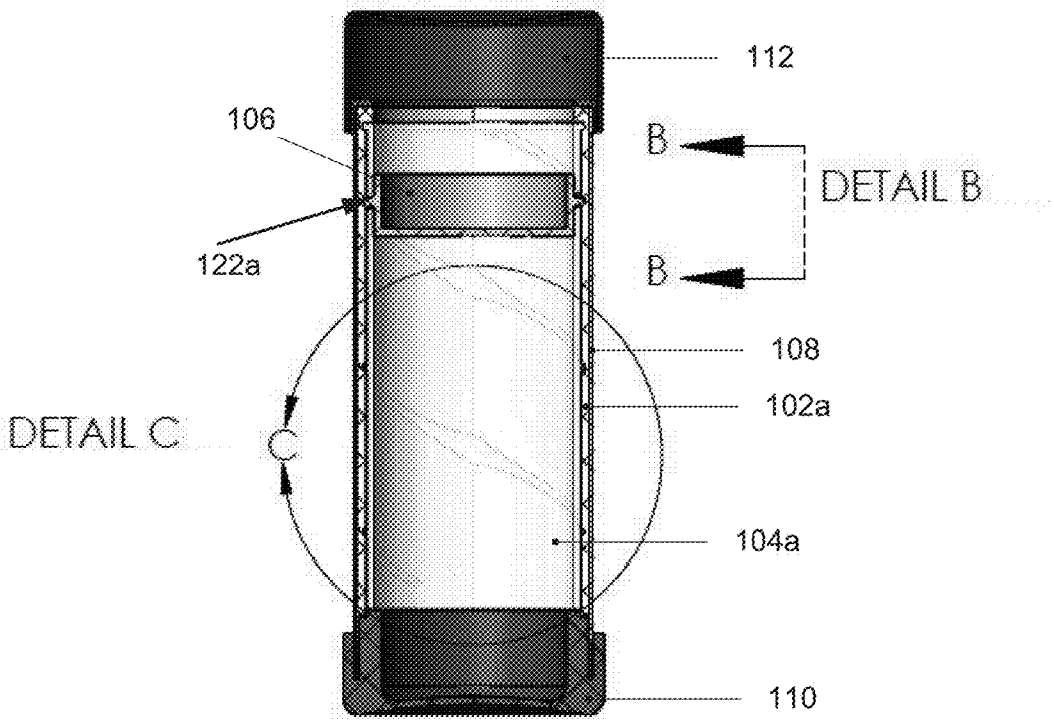
FIG. 3B is an illustration of a cross-section of a container according to the same embodiment.
Figure 3A:
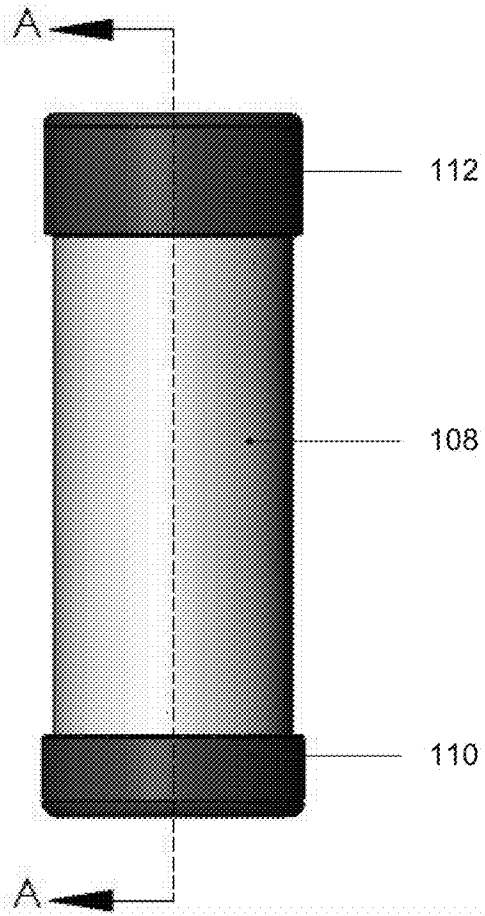
FIG. 3A is an illustration of a container according to the same embodiment.
Figure 3C:
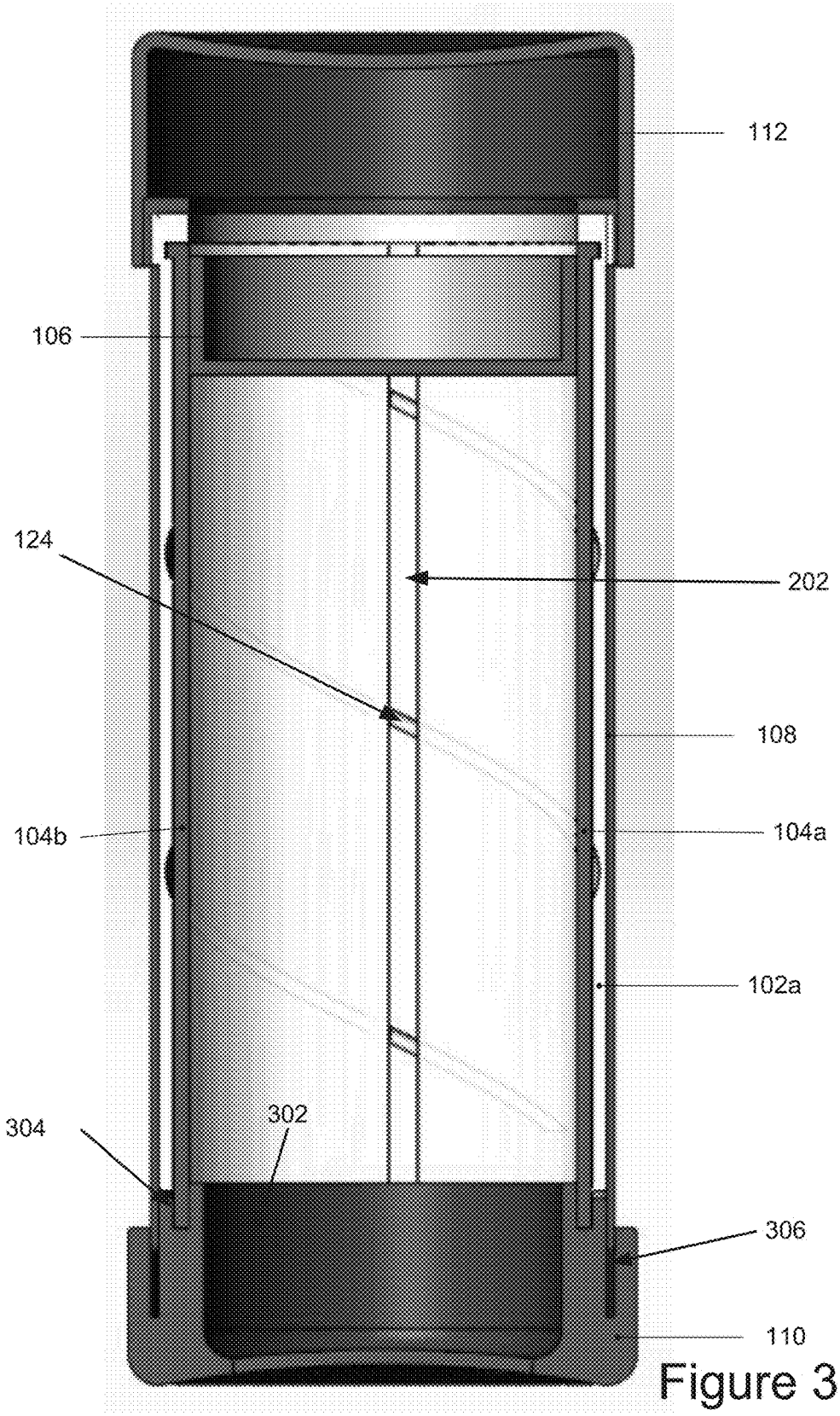
FIG. 3C is an illustration of a different cross-section of a container according to another embodiment.

Referring now to FIG. 3C, which illustrates a cross-section of a container according to one embodiment. In FIG. 3C, details of one embodiment of the bottom cap 110 are illustrated. In the illustrated embodiment, the bottom cap 110 includes a recess that receives the basin portion of the carriage 106. Also, in the illustrated embodiment of FIG. 3C are slots 304 and 306.

Slot 304 receives the drive shell components 104*a* and 104*b*. In one embodiment, the slot 304 is such that an interference fit with drive shell components 104*a* and 104*b* is created, and the tolerances of the interference fit are such that when bottom cap 110 is twisted, both the bottom cap 110 and the drive shell rotate together and relative to the ramp shell 102 with little to no slippage. In other embodiments, slot 302 may have looser tolerances and glue or mechanical fasteners may be used to physically couple the bottom cap 110 and the drive shell 104 together. In some embodiments, slot 304 includes one or more fixed-width spacers that maintain the gap between drive shell components 104*a* and 104*b*, thereby preventing the lug channel 202 from constricting and binding up the whole mechanism.

Slot 306 receives the bottom edge of the outer shell 108. In the illustrated embodiment, the bottom edge of the outer shell 108 is recessed into slot 306, which may prevent skin or other objects from getting caught as the outer shell and bottom cap 110 rotate relative to one another. Slot 306 is wider than the thickness of the outer shell 108, and the outer shell 108 can rotate relative to the bottom cap 110. In one embodiment, a gap is maintained between the portion of the outer shell 108 recessed in the bottom cap 110 and the bottom cap (e.g. they do not make contact).

Referring again to FIG. 1, in some embodiments, the top ring 114 with the outer sleeve 108 holding the pieces of a multi-component ramp shell (e.g. ramp shell components 102*a* and 102*b*) together. In some embodiments, the top ring has a lip that hangs over the bore, thereby narrowing the bore of the container and preventing the carriage 106 from coming out the top of the container.

In some embodiments, the top ring 114 includes one or more fixed-width spacers that maintain the gap between drive shell components 104*a* and 104*b*, which prevents the lug channel 202 from constricting and binding up the whole mechanism.

In some embodiments, the top ring 114 includes an attachment mechanism for the cap 112. The attachment mechanism may vary depending on the embodiment. Examples of attachment mechanisms include, but are not limited to, threads for a threaded cap 112, a hinge for a hinged cap, a latch, bump or snap over, a surface for an interference-fit cap 112, etc.

In some embodiments, the top ring 112 covers any gap that may exist between the ramp shell 102 and the drive shell 104, and may provide a nicer looking surface and keeping people's lips, facial hair, etc. from getting caught in the space between as ramp shell 102 and the drive shell 104.

The top ring 112 is attached by a fastening mechanism, which may include a mechanical fastener, threads, press fit, bump/snap, or a chemical mechanism glue/bonding/weld) on the larger outer diameter of the ramp shell 102.

Figure 4B:
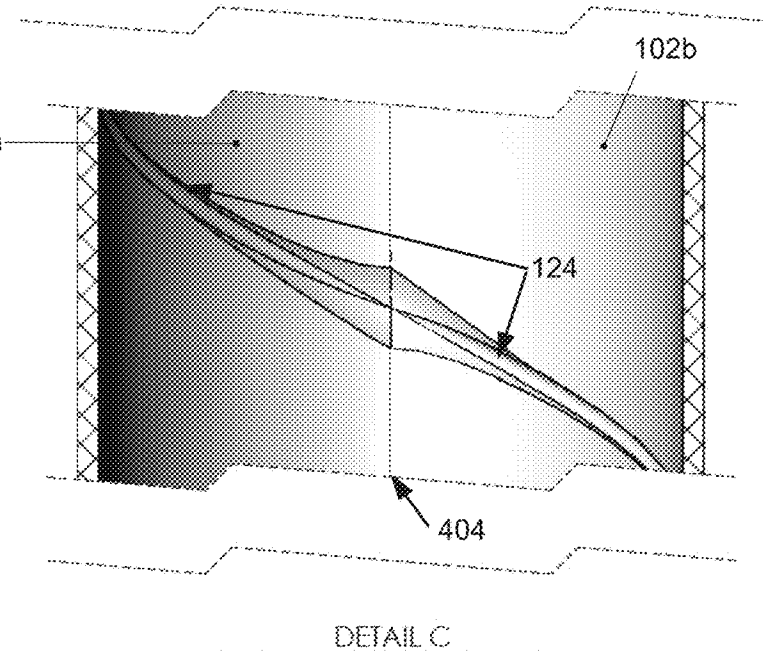
FIG. 4B is a detailed view of flared portions of a ramp according to one embodiment.
Figure 4A:
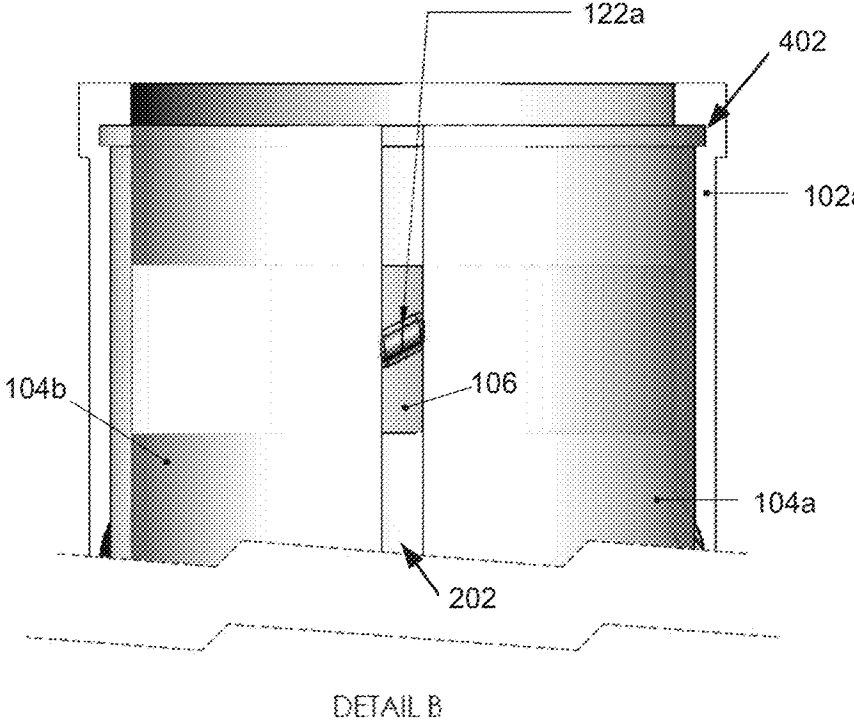
FIG. 4A is a detailed view of a cross section of the container illustrated in FIGS. 3A and 3B according to one embodiment.

FIG. 3A is an illustration of an assembled twist-dispensing wrap container according to the same embodiment. In FIG. 3A, the dotted line indicates a cut line and the arrows marked "A" indicate the direction in which an observer is viewing the cross section, which is illustrated in FIG. 3B. FIGS. 4A and 4B are detailed views of certain aspects of the container as illustrated in FIGS. 3A and 3B.

FIG. 4A is a detailed view of a cross section of the container illustrated in FIGS. 3A and 3B according to one embodiment. At 402, the drive shell 104*a* is illustrated as having a flange around its edge, which fits in a corresponding recess in ramp shell 102 and prevents drive shell 104*a* and ramp shell 102*a* from moving vertically relative to one another. Also illustrated in FIG. 4A is an example of an elongated lug 122*a* in the lug channel 202 according to one embodiment. The lug 122*a* is elongated in a direction at an angle from horizontal. In the illustrated embodiment, the angle at which lug 122*a* of FIG. 4A is elongated corresponds to the angle/pitch of the ramp illustrated in FIG. 4B.

FIG. 4B is a detailed view of flared portions of a ramp according to one embodiment. The vertical line at 404 is a seam where an edge of ramp shell 102*a* abuts an edge of ramp shell 102*b*. Therefore, a multi-component ramp shell 102 embodiment is illustrated in FIG. 4B. Because the lug 122*a* rides within the illustrated groove, a misalignment of where an un-flared groove (not shown in FIG. 4) ends on ramp shell component 102*a* and where an un-flared groove begins on ramp shell component 102*b* could bind the mechanism or otherwise negatively affect the smooth operation of the mechanism.

In the illustrated embodiment, the ramp is gradually flared from the groove width to a greater width over a portion of the groove proximate the edge of the ramp shell component 102*a*/102*b*. In some embodiment, the greater width to which the groove flares is in the range of 1.25-5 times the unflared groove width. The portion of the groove proximate the edge that is flared may vary. In some embodiments, the flare begins between 0.5 and 5 lug lengths (e.g. as measured along the elongated dimension at the pitch of the ramp, if applicable) in from the edge in the direction of the ramp. Depending on the embodiment, the contours of the flare may be a linear flaring/widening, a curved/varying rate of widening, or a combination of both. In one embodiment, the flare is as illustrated in FIG. 4B.

The flaring of a portion of the groove proximate to the edge of the ramp shell 102 provides for smooth operation should there be some misalignment of the grooves of ramp shell components 102*a* and 102*b*, which may occur during assembly or could be due to deteriorating tolerances (e.g. wear in the mold used to cast or stamp the parts). The flaring may also facilitate release of the ramp shell components 102*a*/102*b* from their mold during manufacture (e.g. after being stamped in metal, or after being molded in plastic), in particular, the release of the groove(s) from the ridge(s) in the mold used to form the groove(s). The groove(s) may have different profiled depending on the embodiment. While FIG. 4B illustrates a V-shaped profile to the groove(s), the groove(s) may have a U-shaped profile, square profile, semi-circular profile, or other profile.

Figure 5:
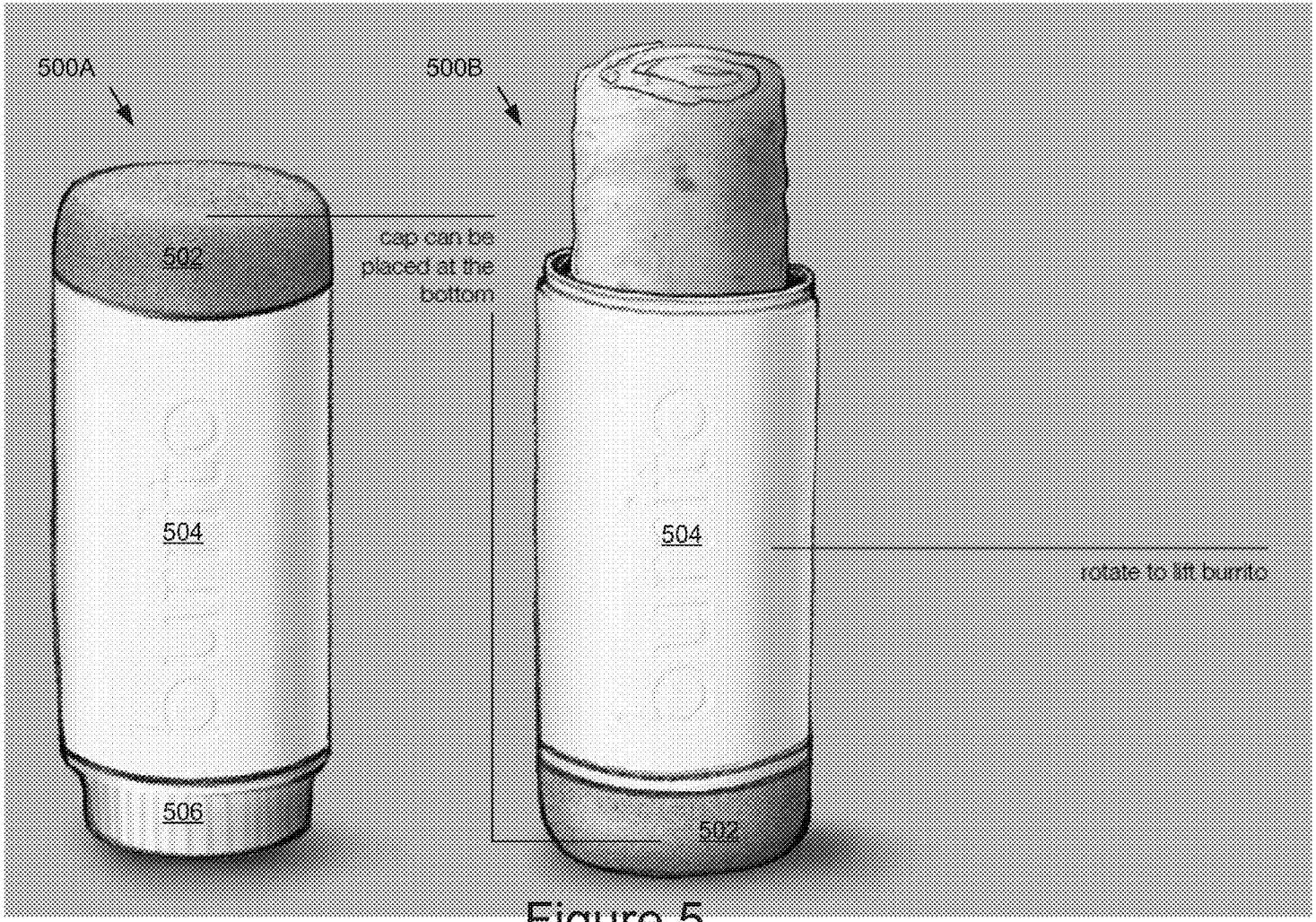
FIG. 5 includes illustrations of an example container in various configurations according to one embodiment.

FIG. 5 includes illustrations of an example a container in various configurations according to one embodiment. The container is illustrated in the closed, or sealed, configuration in 500A, and illustrated in the open configuration in 500B. In FIG. 5, a cap 502, body 504 and base 506 are shown. As illustrated in FIG. 5, when the cap 502 is removed it may be turned over and the base 506 may be nested in the cap 502. When the base 506 is rotated relative to the body 504 it causes a carriage (not shown in FIG. 5) to raise (or lower depending on the direction of rotation) the wrap.

FIG. 6 illustrates the components and configuration of two wrap containers according to some embodiments. FIG. 6 illustrates two variations of wrap containers—600A and 600B. Component "0" is a base component analogous to the base 506 component illustrated in FIG. 5, and also to a combination of the drive shells 104*a*, 104*b* and bottom cap 110 of FIGS. 1-3C. Component "1" is a carriage analogous to carriage 106 in FIGS. 1, 2, 3B, 3C, and 4A. As illustrated, the carriage 1 includes two lugs on opposite sides of the carriage 1. The lug of the carriage 1 moves vertically up and down the lug channel formed in base component 0. The illustrated lug channel runs top to bottom and has notches at the top and bottom. The notches may hold the lug in the fully-extended and fully retracted position, respectively. Component "2" is the body and includes a lug ramp (illustrated as the double helix on the body 2). Depending on the embodiment, the lug ramp may be recessed into the inner surface of the body 2 (e.g. a groove) or raised from the inner surface of the body 2 (e.g. a ridge). The body 2 slips over the base 0. When the base 0 is rotated, also occasionally referred to as twisted, relative to the body 2, the lug channel pushes the lugs, which are long enough to extend beyond the lug channel and interface with the lug ramps, along the lug ramps causing the carriage 1 to move up or down (depending on the direction of rotation) the inner cavity of the twist base 0. Component "3" is a collar that screws onto the base 0 to prevent the body 2 from separating from the base 0. The difference in the variations 600A and 600B is in the collar. The collar 3 of variation 600A is shorter and leaves a portion of the lug channel exposed as a lip. The collar 3 of variation 600B is taller and covers the lug channel to create a continuous, closed lip. Component "4" is a cap. In one embodiment, the cap interlocks with the bottom of the base 0 analogous to the illustration of FIG. 5. In one embodiment, there is sufficient friction in the mechanism (e.g. between the body 2 and the twist base 0 and/or between the carriage 1 and the inside of the cavity of base 0) so that the weight of the wrap does not cause the wrap to retract into the container, also referred to herein as back-driving. In other embodiments, other mechanisms may be included to prevent unwanted movement of the riser.

Figure 9:
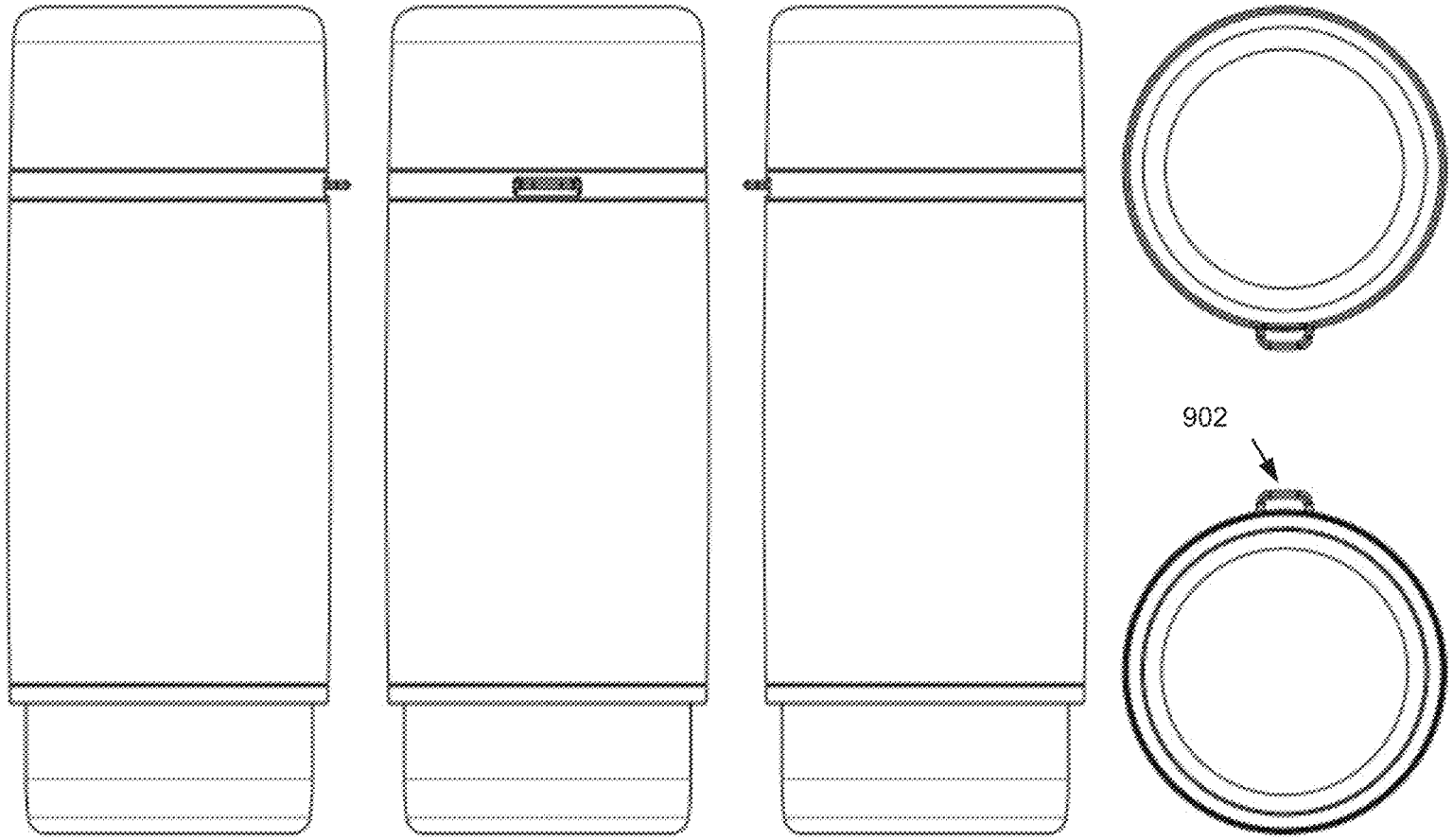
FIG. 9 is an illustration of a top, bottom, left, right, top and bottom view of a container according to one embodiment.
Figure 10:
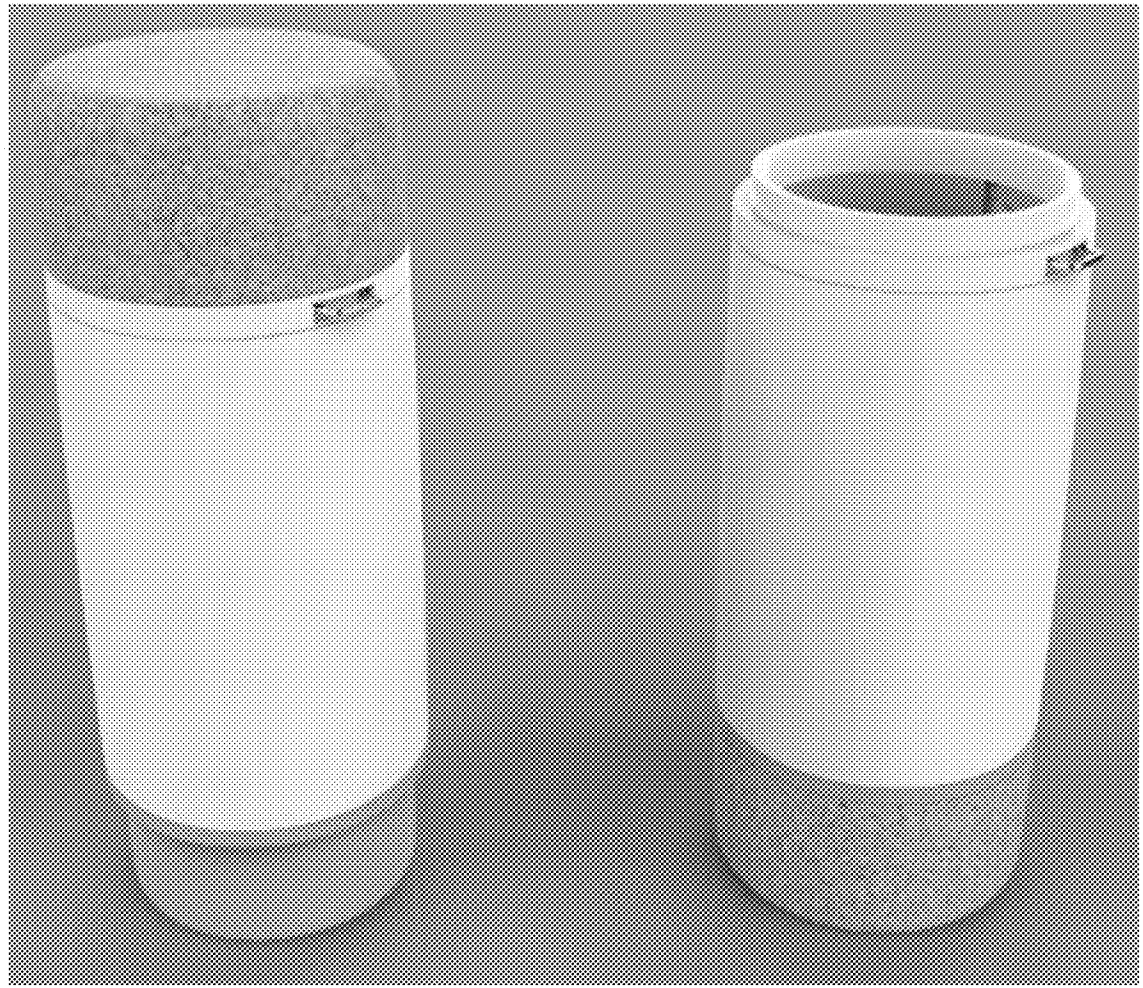
FIG. 10 includes renderings of the container of FIGS. 7-9 according to one embodiment.

FIG. 7 is another illustration of the components of a container according to one embodiment. FIG. 8 is another illustration of the components of a container including hidden lines according to one embodiment. FIG. 9 is an illustration of a top, bottom, left, right, top and bottom view of a container according to one embodiment. In the illustrated embodiment, the collar includes an anchor point 902. The anchor point may be used to connect a removable handle, a carabiner, lanyard or other device for carrying the container. FIG. 10 includes renderings of the twist-dispensing wrap container of FIGS. 7-9 according to one embodiment.

Figure 11:
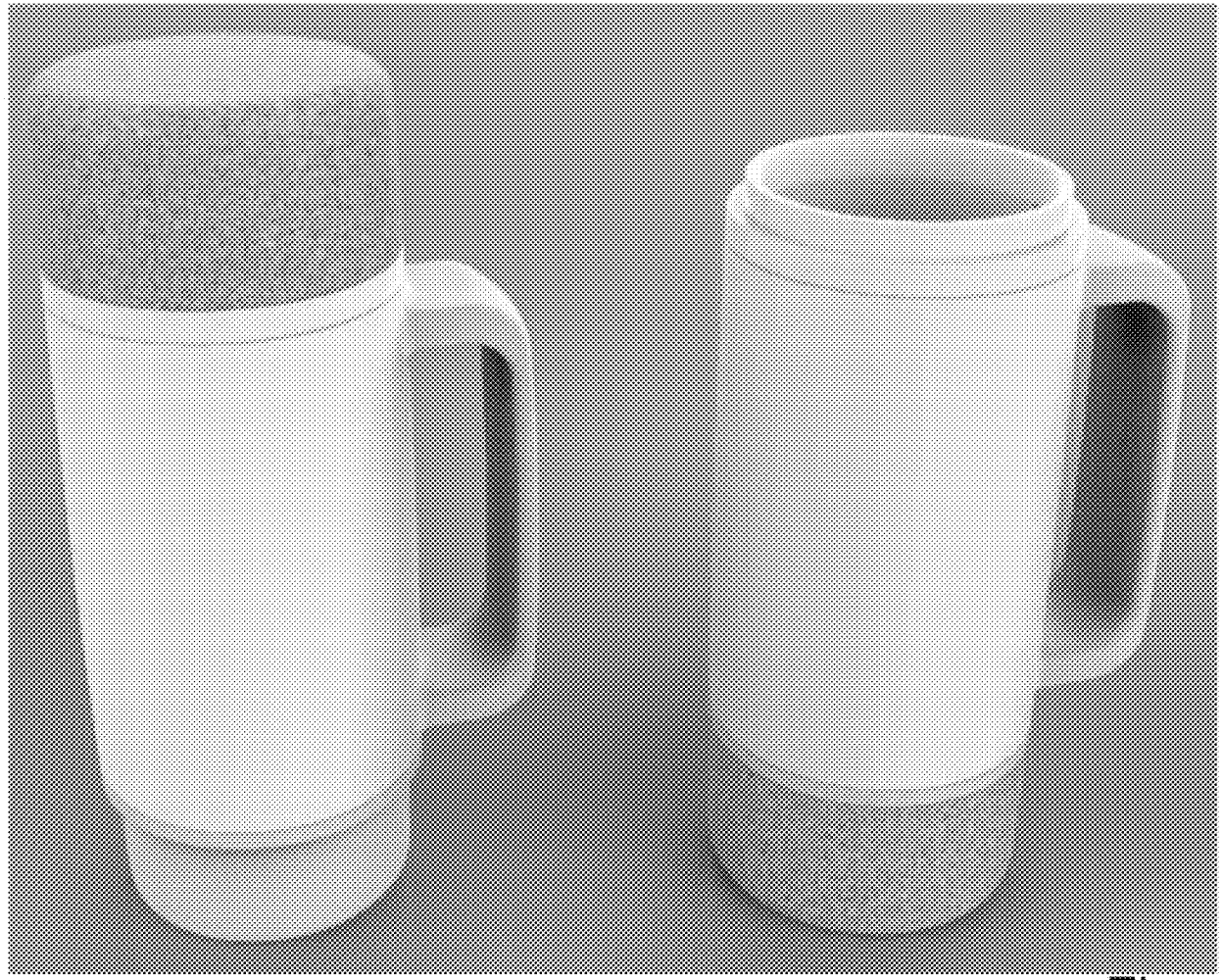
FIG. 11 includes renderings of the container according to one embodiment.

FIG. 11 includes illustrations of a first view of a twist-dispensing wrap container in various configurations according to another embodiment. In FIG. 11, the body includes a built-in handle and the anchor point 902 is omitted.

Although specific embodiments have been illustrated and described herein, it will be appreciated by those of ordinary skill in the art that a variety of alternate and/or equivalent implementations may be substituted for the specific embodiments shown and described. This application is intended to cover any adaptations or variations of the specific embodiments discussed herein.

What is claimed is:

1. A container comprising:

An elevator including (1) a circular cross section when viewed along a first axis, (2) an exterior surface defined by a circumference of the circular cross section, and (3) a first lug extending a first dimension normal to the exterior surface and extending a second dimension normal to the first dimension;

a ramp shell and a drive shell having a common axis of rotation, wherein the common axis of rotation is the first axis;

the drive shell including (1) a thickness and (2) a first edge surface and a second edge surface separated by a gap having a third dimension that is greater than the second dimension of the first lug, and (3) the gap continuing a length of the first edge surface and the second edge surface defining a lug channel; and the ramp shell having an interior surface including a first continuous helical groove recessed into the interior surface, the ramp shell comprising (a) a first ramp shell component including a first edge, a second edge, a half-pipe cross section when viewed along the first axis and a first portion of helical groove recessed into an interior surface of the first ramp shell component, the first portion of helical groove including a first flared section at the first edge of the first ramp shell component and a second flared section at the second edge of the first ramp shell component and (b) a second ramp shell component including a first edge, a second edge, a half-pipe cross section when viewed along the first axis and a second portion of helical groove recessed into an interior surface of the first ramp shell component and wherein, when the first edge of the first ramp shell component is aligned with the first edge of the second ramp shell component, and when the second edge of the first ramp shell component is aligned with the second edge of the second ramp shell component, the first portion of helical groove and the second portion of helical groove form the first continuous helical groove recessed into the interior surface of the ramp shell, wherein the first dimension of the first lug exceeds the thickness of the drive shell, and the first lug extends into the first continuous helical groove recessed into the interior surface of the ramp shell, and wherein, when the ramp shell is rotated in a first direction relative to the drive shell, the first lug travels in a first direction along the lug channel.

2. The container of claim 1, wherein the first portion of helical groove and the second portion of helical groove also form a second continuous helical groove recessed into the interior surface of the ramp shell.

3. The container of claim 1, wherein the second portion of helical groove includes a first flared section at the first edge of the second ramp shell component and a second flared section at the second edge of the second ramp shell component.

4. The container of claim 1, wherein the first ramp shell component is molded using a mold, and wherein the mold includes features for creating the first portion of helical groove including the first flared section at the first edge of the first ramp shell component and the second flared section at the second edge of the first ramp shell component during the molding of the first ramp shell component.

5. The container of claim 4, wherein the first ramp shell component is molded plastic.

6. The container of claim 1, wherein the first lug is elongated in a direction corresponding to the first continuous helical groove.

7. The container of claim 1, wherein the first lug is elongated along an angle corresponding to a pitch of the first continuous helical groove.

8. The container of claim 1, wherein, when the first lug travels in the first direction along the lug channel, the elevator moves parallel to, or along, the common axis of rotation.

9. The container of claim 1, wherein a direction of the lug channel is parallel to the common axis of rotation or along the common axis of rotation.

10. The container of claim 1, wherein the elevator includes a second lug extending the first dimension normal to the exterior surface and the second dimension normal to the first dimension, wherein the second lug is positioned opposite the first lug on the circular cross section of the elevator.

11. The container of claim 1, wherein the elevator includes an interior surface that forms a basin.

12. The container of claim 1, bottom component coupled to a first end of the drive shell, wherein, when the bottom component is rotated, the drive shell is rotated with the bottom component around common axis of rotation and the drive shell moves relative to the ramp shell.

13. The container of claim 1, further comprising:

an insulating outer shell surrounding at least a portion of the ramp shell.

14. The container of claim 1, further comprising:

an outer shell surrounding at least a portion of the ramp shell, wherein a vacuum is pulled and maintained between the outer shell and the ramp shell.

15. The container of claim 1, wherein a portion of the exterior surface of the elevator is in contact with an inner surface of the drive shell, and wherein friction between the inner surface of the drive shell and the exterior surface of the elevator prevents back-driving under load.

16. The container of claim 15, wherein under load includes a weight of a wrap supported by the elevator.

17. A ramp shell comprising:

a first ramp shell component including a first edge, a second edge, a half-pipe cross section when viewed along a common rotational axis and a first portion of helical groove recessed into an interior surface of the first ramp shell component, wherein the first portion of helical groove includes a first flared section at the first edge of the first ramp shell component and a second flared section at the second edge of the first ramp shell component; and a second ramp shell component including a first edge, a second edge, a half-pipe cross section when viewed along the common rotational axis and a second portion of helical groove recessed into an interior surface of the first ramp shell component, wherein the second portion of helical groove includes a first flared section at the first edge of the second ramp shell component and a second flared section at the second edge of the second ramp shell component; and wherein, when the first edge of the first ramp shell component is aligned with the first edge of the second ramp shell component, and when the second edge of the first ramp shell component is aligned with the second edge of the second ramp shell component, the first portion of helical groove and the second portion of helical groove form a first continuous helical groove recessed into the interior surface of a ramp shell comprising the first ramp shell component and the second ramp shell component.

18. The ramp shell of claim 17, wherein the first ramp shell component is molded using a mold, and wherein the mold includes ridges for creating the first portion of helical groove includes a first flared section at the first edge of the first ramp shell component and a second flared section at the second edge of the first ramp shell component during the molding of the first ramp shell component.

19. A container comprising:

An elevator including (1) a circular cross section when viewed along a first axis, (2) an exterior surface defined by a circumference of the circular cross section, and (3) a first lug extending a first dimension normal to the exterior surface and extending a second dimension normal to the first dimension;

a ramp shell and a drive shell having a common axis of rotation, wherein the common axis of rotation is the first axis; and an outer shell surrounding at least a portion of the ramp shell, wherein a vacuum is pulled and maintained between the outer shell and the ramp shell, wherein the drive shell includes (1) a thickness and (2) a first edge surface and a second edge surface separated by a gap having a third dimension that is greater than the second dimension of the first lug, and (3) the gap continuing a length of the first edge surface and the second edge surface defining a lug channel;

wherein the ramp shell has an interior surface including a first continuous helical groove recessed into the interior surface, wherein the first dimension of the first lug exceeds the thickness of the drive shell, and the first lug extends into the first continuous helical groove recessed into the interior surface of the ramp shell, and wherein, when the ramp shell is rotated in a first direction relative to the drive shell, the first lug travels in a first direction along the lug channel.

* * * * *